United States Patent [19]

Swisher

[11] Patent Number: 4,543,807

[45] Date of Patent: Oct. 1, 1985

[54] PLUNGER OPERATED LOCK

[76] Inventor: James A. Swisher, Box 248, Southport, Conn. 06490

[21] Appl. No.: 490,458

[22] Filed: May 2, 1983

[51] Int. Cl.[4] ..... E05B 67/36

[52] U.S. Cl. ..... 70/34; 70/386

[58] Field of Search ..... 70/32-34, 70/386, 395, 397, 398

[56] References Cited

U.S. PATENT DOCUMENTS

| | | | |
|---|---|---|---|
| 3,835,674 | 9/1974 | Hoyt | 70/34 |
| 4,015,456 | 4/1977 | Moberg | 70/34 |
| 4,063,434 | 12/1977 | Moberg | 70/34 |
| 4,155,232 | 5/1979 | Haus, Jr. et al. | 70/34 |
| 4,394,820 | 7/1983 | Swisher | 70/34 |
| 4,441,343 | 4/1984 | Nielsen, Jr. et al. | 70/34 |

*Primary Examiner*—Gary L. Smith
*Assistant Examiner*—Russell W. Illich
*Attorney, Agent, or Firm*—Robert E. Ross

[57] ABSTRACT

A plunger operated lock in which the lock operating plunger is mounted in a plunger housing inside the lock housing and is axially movable therein. The plunger housing is spring biased to the locking position, and the plunger is spring biased to a medial position in relation to the plunger housing. To allow the plunger to move to the un-locking position, the plunger housing must be moved toward the unlocking position far enough to substantially fully compress its biasing spring, and the plunger must be moved axially in the plunger housing toward the unlocking position.

6 Claims, 6 Drawing Figures

PLUNGER OPERATED LOCK

BACKGROUND OF THE INVENTION

In the electric power industry, due to the increasing theft of electricity, it is often necessary to provide positive means for locking closed the cover of an electric meter box. Locking is often accomplished by the use of a plunger operated lock such as is shown in U.S. Pat. Nos. 4,015,456, 4,063,434, and in my co-pending application Ser. No. 236,747 filed Feb. 23, 1981, now U.S. Pat. No. 4,394,820. Un-authorized persons use several different methods for attempting to open locks of this type, including hooked wires, tubing, and adhesives.

The invention disclosed herein provides increased resistance to the un-authorized opening of the lock.

SUMMARY OF THE INVENTION

To reduce the possibility of defeating a lock of this type, I have provided a lock in which the operating mechanism comprises a plunger housing axially movable inside the lock housing, said plunger housing carrying a lock operating plunger which is axially movable in either direction in the plunger housing. Attached to one end of the plunger forwardly of the plunger housing is a locking member which is movable axially with the plunger into and out of a locking position, and has an unlocking portion on the forward end thereof. The other end of the plunger extends rearwardly from the plunger housing for grasping by a lock operating tool inserted into the rear end of the lock housing.

The plunger housing is biased forwardly to the locking position and the plunger is biased to a medial position in the plunger housing.

When the plunger is pulled rearwardly toward the open end of the housing by a suitable operating tool the plunger and the attached locking member first move in the plunger housing rearwardly to reduce the overall length of the operating mechanism, and then the plunger housing moves rearwardly far enough to allow the unlocking portion on the forward end of the locking member to reach the unlocking position, which would not be possible unless the plunger had not moved rearwardly in the plunger housing.

However, when an attempt is made by an unauthorized person to open the lock by inserting a hooked wire into the lock to pull on a spring coil, the overall length of the operating mechanism is not decreased, and therefore even if the spring is pulled until the coils are completely compressed, the forward end of the locking member cannot reach the un-locking position.

Other methods of attempting to defeat the lock are equally ineffective, as is described herein.

DESCRIPTION OF THE ILLUSTRATED EMBODIMENT

Figure 1:
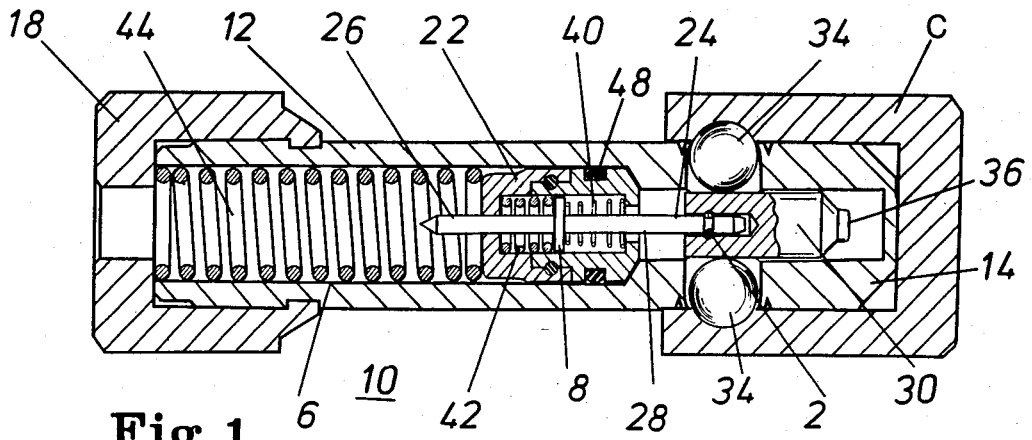
FIG. 1 is a view in side elevation, partly in section, of a plunger operated lock embodying the features of the invention.

Referring to the drawing, there is illustrated a lock 10 of the plunger operated type, which comprises an elongated housing 12 having a closed forward end 14 and an internal axially cavity 16 opening to the rear end 18 of the housing.

A lock operating mechanism 20 is disposed in the cavity for axial movement therein and comprises a plunger housing 22 carrying an operating plunger 24.

The plunger 24 comprises an operating pull-pin 26 extending rearwardly from the housing and a shaft 28 extending forwardly from the housing and carrying a locking member 29 on the forward end thereof, said locking member having a rear portion 30 sized to maintain locking balls 34 in the radially extended position and a forward end portion 36 of reduced diameter which is sized to allow retraction of the balls when the locking member is moved rearwardly to the unlocking position.

The plunger 24 carries a stop member 38 which is normally biased to a medial position in the plunger housing by forward and rear springs 40 and 42.

The entire lock operating assembly is biased forwardly by a main spring 44 to the locking position as illustrated in FIG. 1. The dimensions of the components are such that if the entire operating mechanism 20 is moved rearwardly as far as possible against the force of the main spring 44, the forward unlocking portion 36 of the locking member 29 does not reach a position such that it is opposite the locking balls 34, and the balls therefore cannot move inwardly to allow a locking cap C to be removed. Instead, to allow the unlocking portion 36 to be moved to the unlocking position, the shaft 28 must also move rearwardly in the plunger housing, compressing the spring 42.

Figure 2:
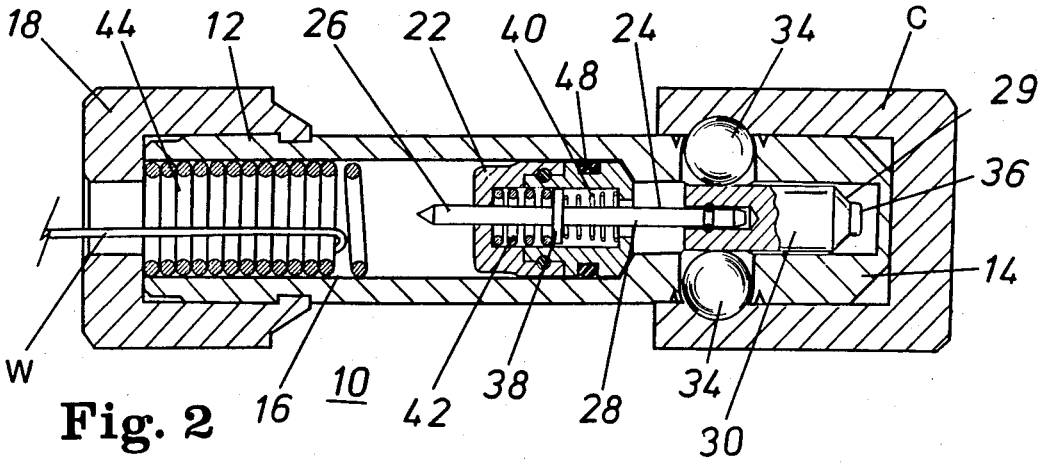
FIG. 2 is a view of the lock of FIG. 1 illustrating an attempt to open the lock by the used of a wire.

Therefore, as illustrated in FIG. 2, if an un-authorized person attempts to open the lock by inserting a wire with a hook on the end into the plunger housing to hook over a coil of main spring 44, even if the wire can pull the main spring until it is completely compressed, the lock cannot be opened since the locking member 29 is not free to move longitudinally in the housing because of friction ring 48, as will be described hereinafter. However, even if the locking member were moved with the main spring, the lock could still not be opened since the locking member 29 cannot reach the un-locking position without the spring 42 also being compressed.

Figure 3:
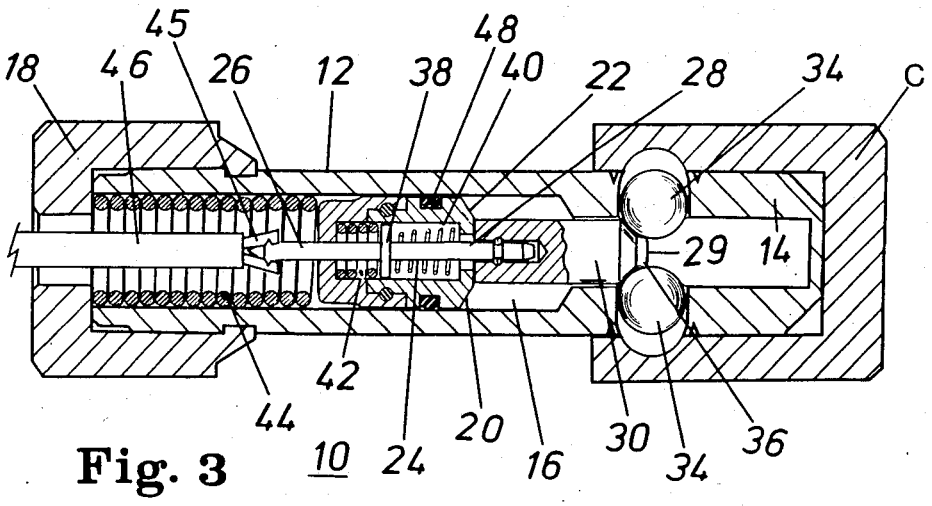
FIG. 3 is a view of the lock of FIG. 1 illustrating the action of the lock components when opened with the proper tool.

However the lock may be readily opened by the use of the proper operating tool as illustrated in FIG. 3, which has projecting fingers 46 and means to cause said fingers to grip the pull-pin 26. Such tools are well-known in the art.

Operation of such a tool first forces the fingers 45 together by a the forward movement of a tube 46, and then draws the fingers rearwardly, pulling the plunger 24 rearwardly compressing spring 42, and then pulling the entire operating mechanism 20 rearwardly against the force of main spring 44. When the spring 44 has been substantially completely compressed, the portion 36 of the locking member reaches the un-locking position, allowing the balls 34 to move inwardly, allowing the locking cap to be removed.

Figure 4:
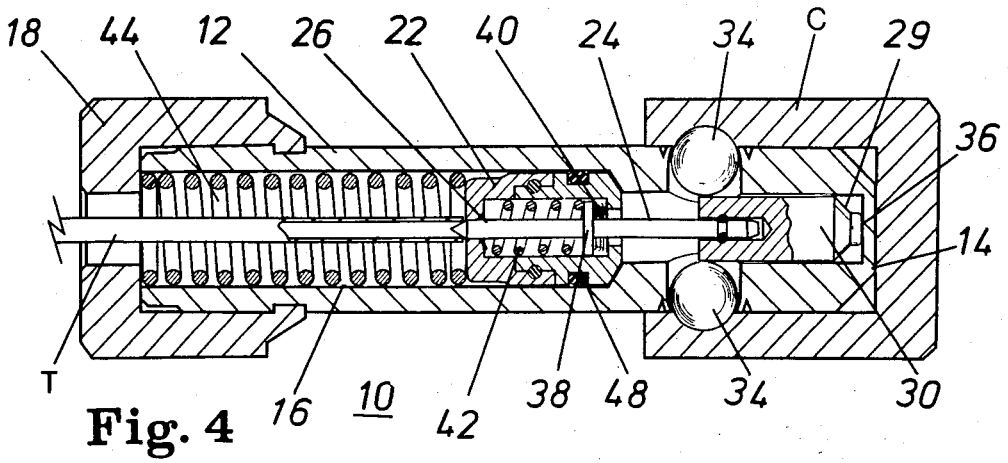
FIG. 4 is a view of the lock of FIG. 1 illustrating the action of the components when a hollow tube is used in an attempt to open the lock.

Referring to FIG. 4, there is illustrated another method which is sometimes used to defeat locks of this type. A piece of tubing T, having an internal diameter only slightly less than the outside diameter of the pull-pin 26, is attempted to be driven over the pull-pin into tight frictional engagement therewith, so that thereafter, pulling on the tubing will pull the pull-pin to open the lock. However in the illustrated lock, when the tubing T is pushed against the pull-pin, it retracts into the plunger housing, compressing spring 40, preventing the tubing from passing over the pullpin.

Figure 5:
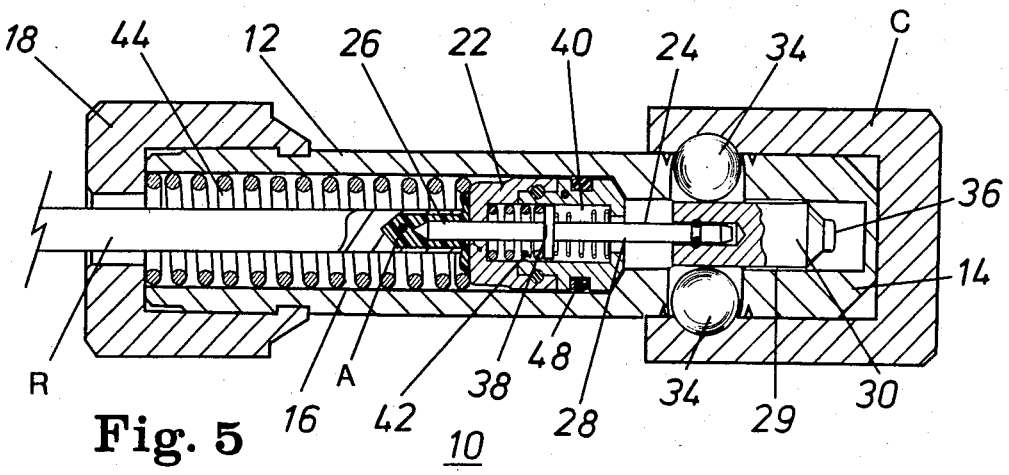
FIGS. 5 and 6 are views of the lock of FIG. 1 illustrating the effect of attempting to open the lock by applying an adhesive to a tube inserted over the operating pin.
Figure 6:
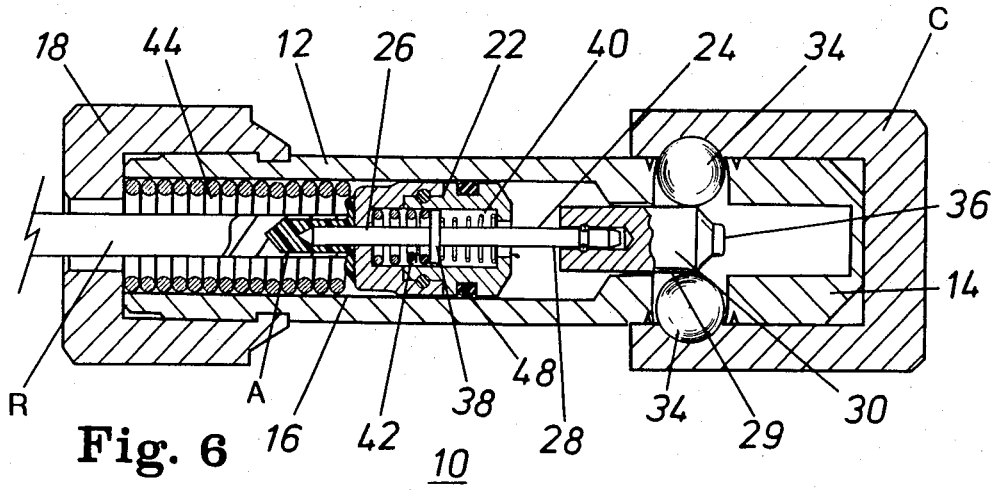

Referring to FIGS. 5 and 6, there is illustrated another method sometimes used to defeat a lock of this type. A rod R is provided with a drilled hole in the end, which has a diameter slightly greater than the diameter of the pull-pin 26, and a quick setting adhesive A, such as an epoxy or cyano-acrylate, is placed in the hole. The rod is then passed over the pull-pin, and held until the adhesive sets, and the pin may then be pulled. However, when the rod is pushed over the pin, the adhesive in the hole in the end of the rod is forced out around the pin, and spreads laterally onto the surface of the plunger housing around the pull-pin. Therefore when the adhesive sets, the pull-pin adheres to the housing, so that the pin cannot move in relation to the housing. Therefore when the rod R is pulled, only the main spring 44 can be compressed, and therefore the locking member 29 cannot be moved in relation to the plunger housing, and the unlocking portion 36 cannot reach the unlocking position.

In the illustrated embodiment of the invention, the plunger housing is provided with an external friction ring 48, which prevents movement of the plunger housing by jarring the lock housing longitudinally, which might otherwise allow the plunger to momentarily be moved to the unlocking position. This feature is also disclosed and claimed in my previously identified copending application Ser. No. 236,747 filed Feb. 23, 1981.

Since certain changes apparent to one skilled in the art can be made in the herein illustrated embodiment of the invention without departing from the scope thereof, it is intended that all matter contained herein be interpreted in an illustrative and not a limiting sense.

I claim:

1. A lock of the plunger operated type which includes a housing with an elongated aperture opening to the rear of the housing and a lock operating plunger assembly axially movable in the housing between a forward locking position and a rear unlocking position, in which the plunger assembly comprises a shaft carrying a forward locking member and a rear locking member positioning portion which are normally biased apart so that the plunger assembly normally has a predetermined overall length which is too great to permit the plunger assembly to move far enough rearwardly to allow the forward locking member to reach an unlocking position, and means projecting rearwardly from the locking member into position for grasping by an operating tool to draw the locking member rearwardly, and means responsive to the drawing of the locking member rearwardly by the operating tool to cause said locking member and said positioning portion to move together in relation to each other whereby the overall length thereof is shortened an amount that will allow the locking portion to reach the unlocking position, in which the means projecting rearwardly from the locking member comprises a shaft extending through the rear positioning portion and projects rearwardly therefrom, in which the rear positioning portion comprises a shaft housing and said shaft has a stop member disposed thereon in the shaft housing, and biasing means is provided in the shaft housing on both sides of the stop member to maintain said stop member in a medial position in the shaft housing so that said forward locking member and the shaft housing are maintained in a position so as to have said overall length, whereby forward movement of said shaft causes said overall length to increase and rearward movement causes said overall length between the forward end of the forward locking member and the rear end of the housing to decrease.

2. A lock of the type having a housing with an elongated aperture opening to the rear of the housing and a lock operating assembly axially movable in the aperture and biased forwardly to a locking position and movable rearwardly to an unlocking position, in which said lock operating assembly has a forward locking component and a rear positioning component, means normally biasing said components to a predetermined spacing in relation to each other such that the assembly, when said components are so spaced, cannot be moved rearwardly far enough to allow the forward component to reach the unlocking position, the forward component carrying a shaft extending rearwardly through the rear positioning component and projecting rearwardly therefrom for grasping by an operating tool inserted into the rear of the housing, the dimensions of the components being such that when the shaft and forward locking component are pulled rearwardly by the operating tool, the forward locking component moves rearwardly in relation to the rear component so that on subsequent rearward movement of the entire assembly the forward locking component can reach the unlocking position.

3. A lock as set out in claim 2 in which said shaft has a stop member disposed thereon in said rear component, and means in said component biasing said stop means to a medial position therein, whereby forward pressure on the end of the shaft extending rearwardly from the rear component will cause said shaft to be depressed into said component.

4. A lock as set out in claim 2 in which means is provided for frictional engagement between one of the components and the housing to prevent rearward movement of the components by inertial forces resulting from axial forces applied to the lock.

5. A lock of the type comprising a housing having an elongated aperture opening to the rear thereof, a locking element at the forward end of the housing movable between an extended locking position and a retracted unlocking position, and a lock operating plunger movable axially in the aperture between a forward locking position in which a forward locking member of the plunger maintains the locking element in the extended position and a rear unlocking position in which the locking element can retract to the unlocking position, said plunger having a rearwardly extending shaft for engagement by an operating tool to pull the plunger rearwardly to the unlocking position, and a positioning member disposed on said shaft rearwardly of the forward locking member, the overall length between the rear end of the positioning member and the forward end of the forward locking member being such that when the plunger moves rearwardly the forward locking member cannot reach the unlocking position unless the positioning member moves in relation to the forward locking member to decrease the distance therebetween, said positioning member being mounted on the shaft for limited axial movement thereon in either direction, and means biasing said positioning member to a medial position.

6. A lock as set out in claim 5 in which said positioning member is normally biased forwardly against a stop, and means is provided for normally resiliently maintaining the forward locking member and said positioning member in a predetermined spaced relationship, said members being movable toward and away from each other a predetermined distance.

* * * * *